US007818824B2

(12) United States Patent
Honsa

(10) Patent No.: US 7,818,824 B2
(45) Date of Patent: Oct. 26, 2010

(54) PORTABLE BABY SANITIZER WITH AIR PUMP

(76) Inventor: Patrick J. Honsa, 18406 De Jong La., Lansing, IL (US) 60438

( * ) Notice: Subject to any disclaimer, the term of this patent is extended or adjusted under 35 U.S.C. 154(b) by 492 days.

(21) Appl. No.: 12/019,631

(22) Filed: Jan. 25, 2008

(65) Prior Publication Data

US 2009/0188033 A1 Jul. 30, 2009

(51) Int. Cl.
*A47K 3/20* (2006.01)

(52) U.S. Cl. ..... 4/420.3; 4/447

(58) Field of Classification Search ..... 4/420.3, 4/443–447

See application file for complete search history.

(56) References Cited

U.S. PATENT DOCUMENTS 429,374 A * 6/1890 Charlesworth ..... 4/444
3,034,137 A * 5/1962 Glou ..... 4/445
3,416,529 A * 12/1968 Weisman ..... 604/276
3,678,932 A * 7/1972 Hudson ..... 604/259
3,916,453 A * 11/1975 Dominguez-Armada ..... 4/445
5,241,712 A * 9/1993 Mahoney ..... 4/420.2
5,361,427 A * 11/1994 Wilk ..... 4/420.3
5,682,626 A * 11/1997 Banks et al. ..... 4/541.5
5,951,511 A * 9/1999 Lowder ..... 604/73
6,339,853 B1 * 1/2002 Apostolo ..... 4/444
2008/0078847 A1 * 4/2008 Lai ..... 239/373

* cited by examiner

*Primary Examiner*—Charles Phillips
(74) *Attorney, Agent, or Firm*—Davis M. Chin, Jr.; Davis Chin

(57) ABSTRACT

A portable baby sanitizer with air pump device is provided which allows a user to activate a pressurizable chamber, that will dispense a multiplicity of liquid streams onto, and in order to cleanse, a baby's bottom. The sanitizer device includes the pressurizable chamber which has an air pump and an air release valve. The chamber is in direct fluid flow communication with a seat. The seat contains a liquid holding reservoir which dispenses a liquid spray, when the air release valve is engaged, through a plurality of discharge holes that are disposed along the inner rim of the seat. The sanitizer device can be used in conjunction with an independently transportable stand or in conjunction with a standard toilet.

20 Claims, 4 Drawing Sheets

PORTABLE BABY SANITIZER WITH AIR PUMP

BACKGROUND OF THE INVENTION

1. Field of the Invention

This invention relates generally to portable baby sanitizers for cleansing a baby's bottom, and more particularly, the present invention relates to a portable device, which has a pressurizable chamber, that upon demand, will dispense a multiplicity of liquid streams onto, and in order to cleanse and treat diaper rash on, a baby's bottom.

2. Description of the Prior Art

Ever since the convenient use of diapers to control and contain infant waste, a great concern for parents and caretakers alike has been diaper rash. Unfortunately, diaper rash is a common result of wearing diapers and may be caused by any number of reasons. The most general reason for diaper rash is commonly referred to as a friction rash, which is caused by the constant rubbing of the diaper against the infant's skin. The most pronounced areas affected by friction rash are where the elastic of the diapers are too tight. Luckily, this type of rash is quickly curable by frequent diaper changing, airing out of the infant's skin and the use of protective barriers.

There are, however, more severe types of diaper rash that are less easily treatable. These other types of diaper rash, to name a few, include irritant rash, allergic rash, Intertrigo and Seborrhea rash. Particularly, irritant rash is usually caused by prolonged exposure of the infant's skin to stool enzymes. Ironically, a parent or caretaker will generally treat this rash with harsh soaps, baby wipes, detergents or topical medicines that in turn are irritants to the infant. Thus, a concerned parent who is trying to clean the effected area is actually causing more irritation to the infant. As a result, the infant's outer most layer of skin becomes even more damaged.

Once the infant is re-diapered, and because the effected area is concealed from the parent's view, the rash will continue to develop and worsen as the effected area comes into contact with the infant's fecal matter and urine. Since the protective layer of skin has been breached it is inevitable that microorganisms such as yeast or bacteria will eventually invade the damaged skin.

Since the infant's skin has been tainted with microorganisms the rash will be less responsive to the usual treatments. Continuing to air dry the infant's skin is helpful, but having the infant without a diaper on for extended amounts of time presents the problem that the infant may make a mess, which is unsanitary and difficult to clean up. Applying over-the-counter creams to the rash is also a helpful treatment, but in view of the fact that the infant's skin is extremely sensitive, due to the rash, rubbing the cream onto the effected areas of the infant's skin may cause the infant additional pain and suffering. Yet another helpful remedy in treating this more severe type of rash is to wash the infant's skin with warm water or with a mixture of warm water and baking soda. Although this seems to be the most soothing remedy for the infant, it requires the time consuming task of drawing a bath each and every time the diaper is changed, which every parent and caretaker knows is more than quite frequent.

Therefore, it should come as a surprise that a portable baby sanitizer has not been developed and constructed heretofore in the prior art so as to dispense a soothing liquid mixture onto an infant's bottom for the purpose of treating diaper rash. Because a device like this is not in the prior art, it would be desirable to provide a device like this to parents and caretakers of infants.

A prior art search directed to the subject matter of this application in the U.S. Patent and Trademark Office revealed the following Letters Patent:

| |
|---|
| 3,808,608 |
| 3,916,453 |
| 4,340,980 |
| 5,090,067 |
| 5,335,855 |
| Des. 378,697 |

In U.S. Pat. No. 3,808,608 to Caplan issued on May 7, 1974, there is disclosed a bidet-like device which is used in connection with a standard toilet. The device comprises a water holding reservoir and an electric motor which drives a pump that discharges water through a single flexible conduit onto an individual's underside. The reservoir and electric motor sits on the top surface of the toilet tank while the flexible conduit runs down the length of the toilet tank and clips onto the seat of the toilet.

In U.S. Pat. No. 5,090,067 to Cogdill issued on Feb. 25, 1992, a bidet apparatus associated with a conventional toilet is disclosed. The apparatus comprises a water tank with an immersion heater, a flexible conduit with a single spray head and a pump. The water tank is located along the exterior side of the toilet water tank with the flexible conduit being connected from the water tank to the toilet seat and provides a single stream of spray generated from the pump.

In U.S. Pat. No. 4,340,980 to Fushimi et al. issued on Jul. 27, 1982, there is disclosed a water closet with topical body washer mechanism. The mechanism includes a water warmer mounted on the water closet and a spout pipe for spraying warm water onto the underside of a user.

In U.S. Pat. No. 5,335,855 to Borod issued on Aug. 9, 1994, there is disclosed a hygienic spray bottle. The hygienic spray apparatus includes a storage container, a spray bottle, an air pump, a manual valve, a discharge port and a pickup tube. The air pump is manually operated to create pressure within the storage container. When the manual valve is released a pressurized liquid is forced through a selectable single discharge hole via the discharge port.

The remaining patents, listed above but not specifically discussed, are deemed to be only of general interest and show the state of the art in bidet-like devices and portable, pump-activated hygienic cleaners.

None of the prior art discussed above discloses a portable baby sanitizer like that of the present invention which provides a portable baby sanitizer that is capable of dispensing pressurized liquids, particularly medicaments for diaper rash, onto a baby's bottom while the baby is in a seated position.

SUMMARY OF THE INVENTION

Accordingly, it is a general object of the present invention to provide a portable baby sanitizer with air pump to treat a baby's diaper rash by spraying a soothing liquid onto the baby's bottom and avoiding the time consuming process of drawing a bath to achieve a similar remedy, but yet overcomes the disadvantages of the prior art.

It is an object of the present invention to provide a portable baby sanitizer with air pump to cleanse and dry an infant's bottom before diapering.

It is another object of the present invention to provide a portable baby sanitizer with air pump which is of a durable construction, affordable in cost, and is relatively easy to be transported, assembled and operated by the average user.

It is still another object of the present invention to provide a portable baby sanitizer with air pump which may be used in conjunction with a standard toilet bowl without the requirement of special drainage.

It is yet still another object of the present invention to provide a portable baby sanitizer with air pump which is capable of being cleaned in a dishwasher.

In a preferred embodiment of the present invention, there is provided a portable baby sanitizer with air pump which allows a user to cleanse and treat a baby's diaper rash. The sanitizer device includes a pressurizable chamber which dispenses liquid through discharge holes that are disposed along an inner rim located on a reservoir contained seat as a result of manually pumping air into the chamber and releasing the pressure by engaging the air release valve.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
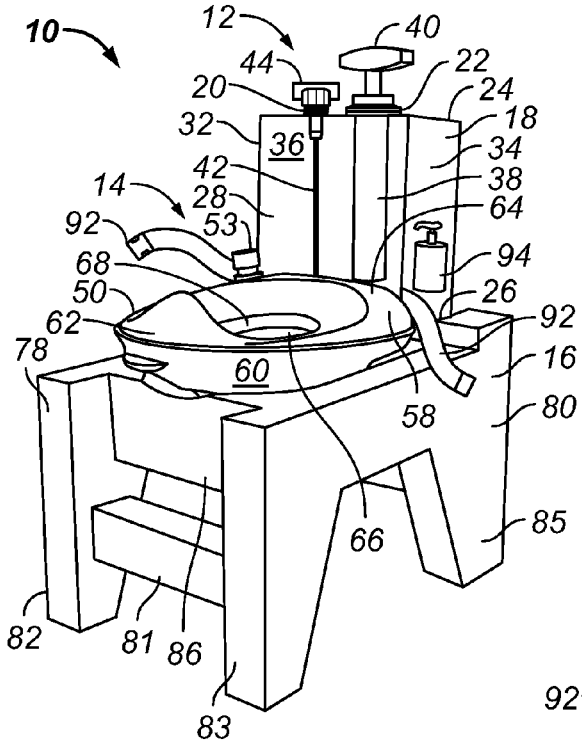
FIG. 1 is a perspective view of the fully assembled portable baby sanitizer with air pump, constructed in accordance with the principles of the present invention.
Figure 2:
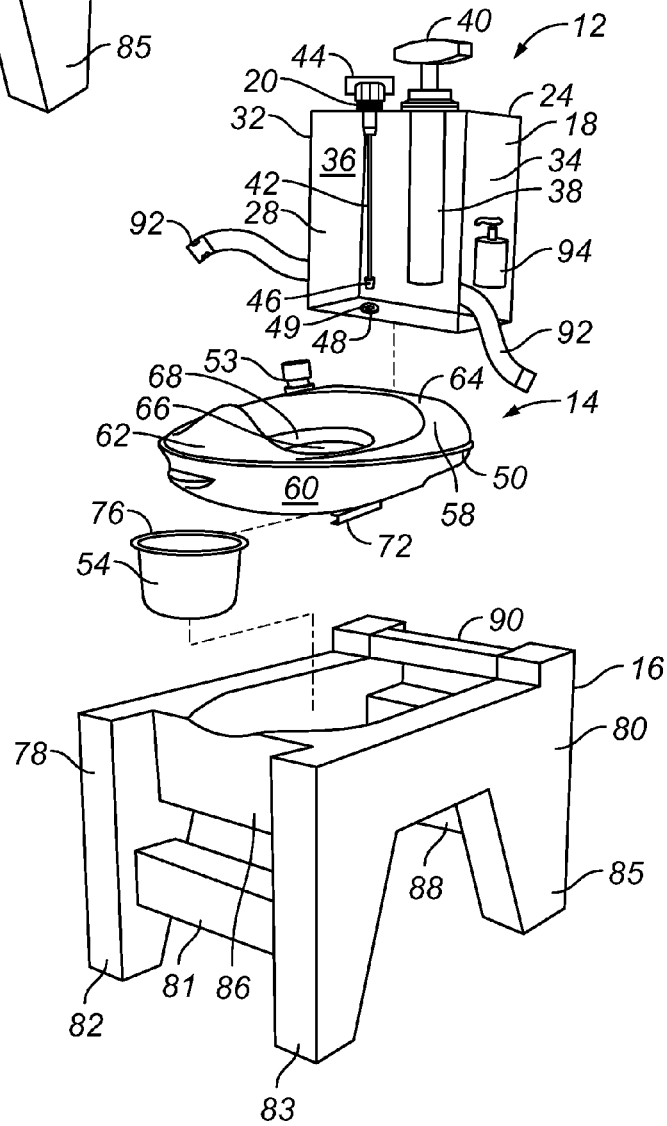
FIG. 2 is an exploded perspective view of FIG. 1, showing the main components of the present invention.

It is to be distinctly understood at the outset that the present invention shown in the drawings and described in detail in association with a portable baby sanitizer with air pump is not intended to serve as a limitation upon the scope or teachings thereof, but is to be considered merely for the purpose of convenience of illustration of one example of its application.

Referring now in detail to the drawings, wherein like reference characters designate like or corresponding parts throughout the several views, there is illustrated in FIGS. 1 through 8 a portable baby sanitizer with air pump device 10 constructed in accordance with the principles of the present invention.

As shown in FIG. 1, the sanitizer device 10 is defined by a tank assembly 12, a seat assembly 14 and a stand 16. Particularly, the tank assembly 12 includes a tank 18, an air release 20 and an air pump 22. The tank 18 has a top surface 24, a bottom surface 26, a front surface 28, a back surface 30, a left side surface 32 and a right side surface 34, which are all formed to create a substantially rectangular air-tight storage chamber 36. The tank 18 is made from any durable plastic preferably of transparent or translucent material. While the tank 18 has been described as having a substantially rectangular shape, it should be understood to one skilled in the art that the tank may be of any other suitably designed shape such as spherical, elliptical, oval, etc.

The air release 20 and air pump 22 are both threadedly attachable to top surface 24 of tank 18. The air pump 22 is, as illustrated, a manual hand pump with a cylindrical body 38 and a handle 40. Although a hand pump is described as the best mode, it is conceivable that any other compression device may also be used in a similar fashion such as an electrically driven or foot operated pump. Once the air pump 22 is threaded onto the top surface 24 of tank 18 the cylindrical body 38 of the pump 22 will be located within the storage chamber 36 and the handle 40 will be located exterior to the chamber 36.

The air release 20 includes a shaft 42, a threaded cap 44 and a valve plunger 46. The threaded cap 44 is located at one end of the shaft 42 while the valve plunger 46 is located at the opposite end of the shaft 42. Once the threaded cap 44 of the air release 20 is screwed onto the top surface 24 of tank 18 the shaft 42 and valve plunger 46 will be located within the storage chamber 36. As best seen in the enlarged detailed perspective view of FIG. 7, when the threaded cap 44 is fully engaged the valve plunger 46 sits snugly into a socket 48, which is located on the bottom surface 26 of tank 18, and creates an air-tight seal within storage chamber 36. The socket 48 is placed in a surrounding relationship with an aperture 49 that is located on the bottom surface 26 of the tank 18. The aperture 49 leads directly into and is in fluid communication with the seat assembly 14. Alternatively, any other air release mechanism may used such as an air release assembly including an air release button, valves, an expansion spring and a metal release rod.

Figure 6:
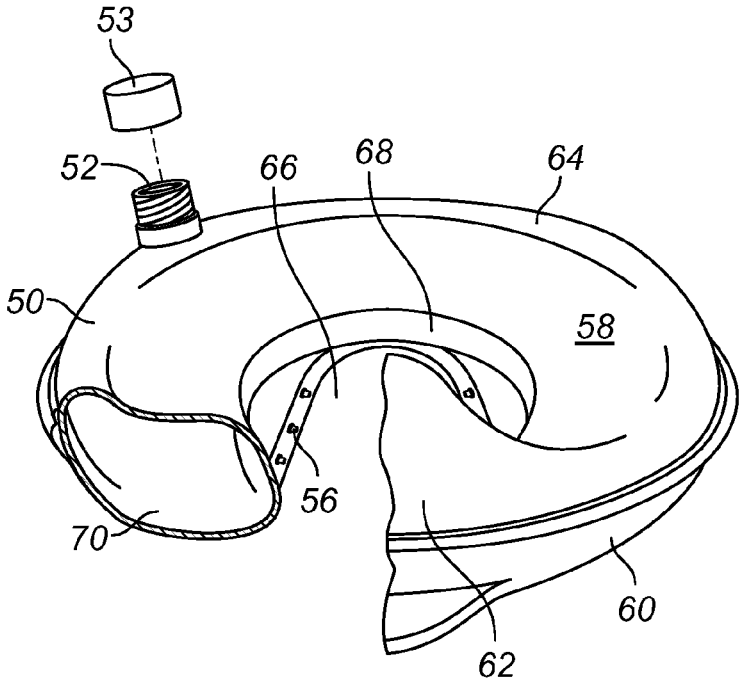
FIG. 6 is a partial sectional view of the seat of FIG. 1, showing the internal reservoir within the seat.
Figure 7:
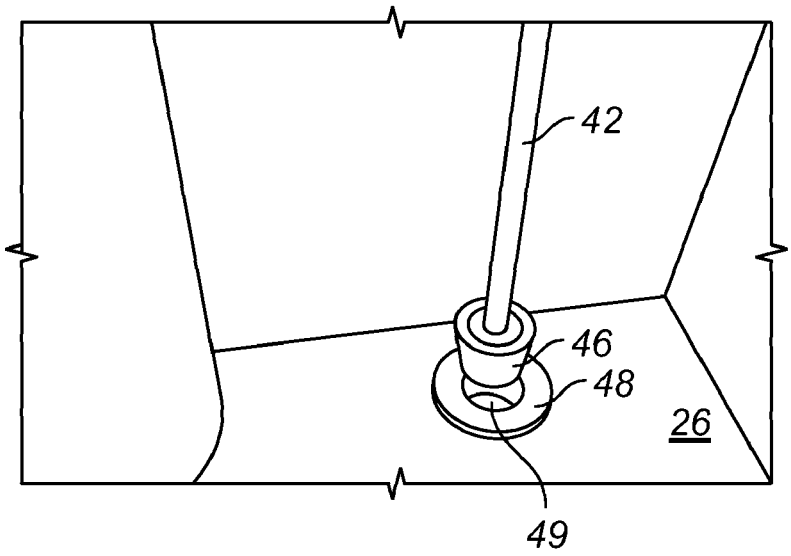
FIG. 7 is an enlarged detailed perspective view of the valve plunger and socket of the tank assembly of FIG. 4.

The seat assembly 14 includes a seat 50, a fill hole 52 with a cap 53, a removable waste container 54 and a plurality of discharge holes 56, preferably six upwardly oriented discharge holes. The plurality of discharge holes includes a first set of three upwardly oriented discharge holes **56*a* and a second set of three upwardly oriented discharge holes 56*b*. The first set of discharge holes 56*a* are oppositely and symmetrically disposed, across a center hole 66, to the second set of discharge holes 56*b*. The seat 50 has a top portion 58, a bottom portion 60, a front end 62, a back end 64 and the center hole 66, which has an inner rim 68. The top portion 58 and bottom portion 60 of seat 50 are formed so that an internal reservoir 70 is located within the two portions, as shown in FIG. 6. The top portion 58** is suitably contoured and dimensioned to comfortably receive the bottom end of a seated baby.

The fill hole 52 is disposed onto the top portion 58 of the seat 50 and is located near the back end 64. Male threads of fill hole 52 protrude slightly upward from the top portion 58 of seat 50 and are designed to engage with the female threads of cap 53. The fill hole 52 is a direct opening to the internal reservoir 70.

Figure 3:
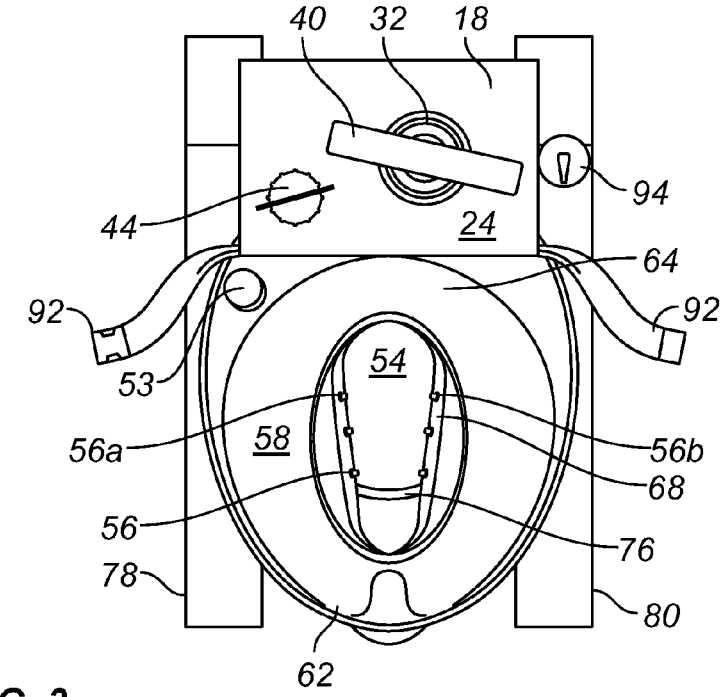
FIG. 3 is a top plan view of the fully assembled portable baby sanitizer with air pump of FIG. 1.
Figure 4:
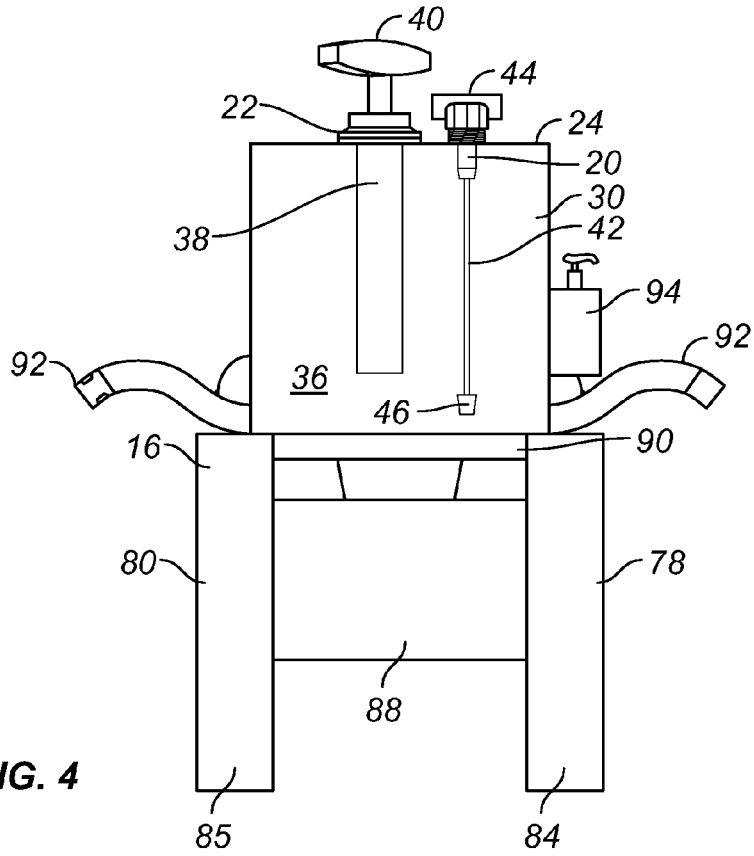
FIG. 4 is a back plan view of the fully assembled portable baby sanitizer with air pump of FIG. 1.

As shown in FIG. 3, there are six discharge holes 56 located along the inner rim 68 of seat 50. Although six discharge holes are shown, it should be understood by those skilled in the art that any number, more or less, of discharge holes may be incorporated along the inner rim 68 as desired.

Figure 5:
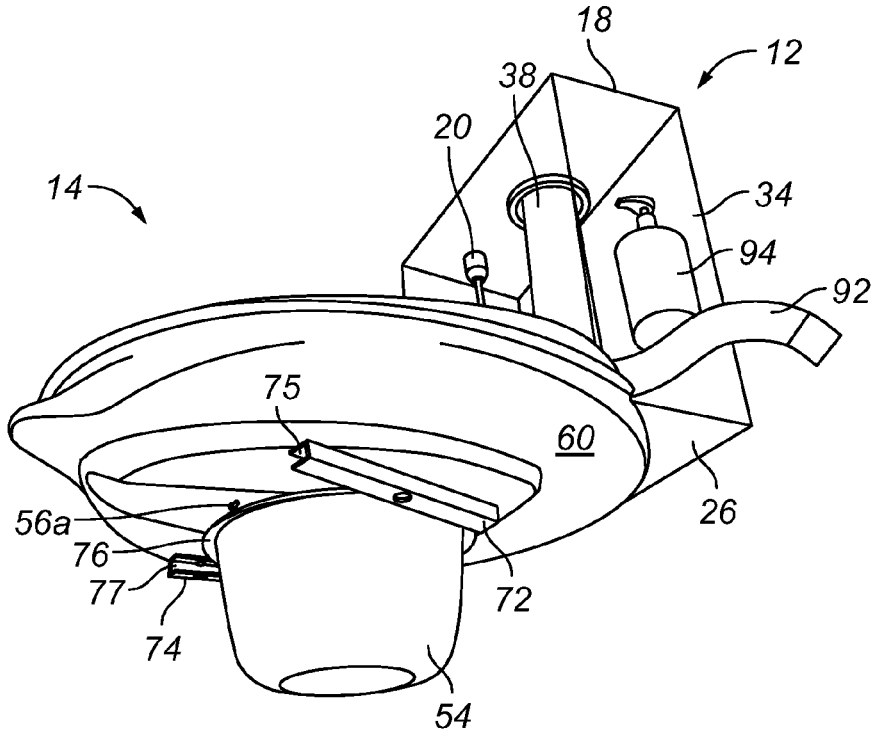
FIG. 5 is a bottom perspective view detailing the feature of the removable waste receptacle of FIGS. 2 and 3.

Referring to FIG. 5, track rails 72, 74 are mounted onto the bottom portion 60 of seat 50 with one rail being disposed on either side of the center hole 66. The rails 72, 74 are formed with respective channels 75, 77 which are adapted to slidably receive therein the lip edge 76 of removable waste container 54 so that container 54 is positioned directly underneath the center hole 66 of seat 50 in order to catch drain off liquid from the discharge holes 56 and/or waste from a baby.

When the sanitizer device 10 is manufactured the tank assembly 12 and the seat assembly 14 will be preferably molded as a single continuous piece by an injection molding process or the like. In particular, the bottom surface 26 of the tank 18 is joined to the back end 64 and top portion 58 of seat 50. As described previously, the socket 48 located on the bottom surface 26 of tank 18 has the aperture 49 that leads into a corresponding aperture (not shown) located on seat assembly 14 and directly to the internal water reservoir 70. Again, when the threaded cap 44 of the air release 20 is fully engaged the valve plunger 46 fits snugly into the socket 48 and creates an air-tight storage chamber 36 within the tank 18.

Moving along, the stand 16 is designed to receive the fully joined tank assembly 12 and seat assembly 14. Stand 16 has a left vertical member 78 and a right vertical member 80. Each vertical member 78, 80 has a respective front leg 82, 83 and a respective rear leg 84, 85. A first horizontal cross member 81 joins left vertical member 78 with right vertical member 80 at a point substantially near the bottom of front legs 82, 83. Similarly, a second horizontal cross member 86 joins left vertical member 78 with right vertical member 80 at a point substantially near the top of front legs 82, 83. A third horizontal cross member 88 joins left vertical member 78 with right vertical member 80 at a point substantially near the bottom of rear legs 84, 85. Additionally, a platform 90 joins left vertical member 78 with right vertical member 80 at the top rear portion of each vertical member 78, 80. The stand 16 is configured in this manner so as to support the weight of a baby who is seated in the device 10. Therefore, a person of ordinary skill will appreciate that stand 16 may be of any configuration as long as it suitably accommodates or receives the joined tank assembly 12 and seat assembly 14 in the desired operational position, and stably supports the weight of a baby.

Referring back to FIGS. 1 and 2, the bottom surface 26 of tank 18 rests along the length of the platform 90 while the bottom portion 60 of the seat 50 rests partially on top of, and between, the left and right vertical members 78, 80. The placement of the joined tank assembly 12 and seat assembly 14 onto the stand 16 is designed in such a way so that joined tank assembly 12 and seat assembly 14 will not be dislodged from the stand 16 during use.

Additionally, a restraining means 92 for securing a baby onto seat 50 may be attached to either the tank 18 or the stand 16. The restraining means 92 may be a belt with a clasping means such as Velcro, snaps, buttons or clasps. Further, a liquid soap dispenser 94 may be conveniently attached to tank 18 on back surface 30, left side surface 32 or right side surface 34.

During operation of the device 10, a user will begin by unscrewing cap 53 in order to expose fill hole 52 for the purpose of filling the internal reservoir 70 with a desired amount of water, a predetermined mixture of water and baking soda or any other liquid medicaments. The user will then fully engage the threaded cap 44 of air release 20 so that the storage chamber 36 is completely air-tight due to the fact that valve plunger 46 is fully inserted into socket 48. Next, the user will activate the air pump 22 to compress the air within storage chamber 36. Alternatively, a user may unscrew air pump 22 so as to fill storage chamber 36 partially with liquid in order to reduce the amount of compressions needed to pressurize the storage chamber 36.

After the user places the joined tank assembly 12 and seat assembly 14 securely onto the stand 16, and also slides the waste container 54 into the track rails 72, 74 and directly underneath the center hole 66, the user can then safely place the baby onto the seat 50. Once the threaded cap 44 of air release 20 is unscrewed, the valve plunger 46 disengage from the socket 48 and allow the compressed air to force the liquid in the reservoir 70 through the discharge holes 56 spraying the baby's bottom. The distance between the valve plunger 46 and the socket 48, controlled by the amount of turns of the threaded cap 44, will determine the force at which the liquid will spray through the discharge holes 56. When the liquid is fully discharged the user can leave the valve plunger 46 in its disengaged position from the socket 48 and activate air pump 22 to force air through the discharge holes 56. This will help facilitate the drying of the baby's bottom before re-diapering.

Figure 8:
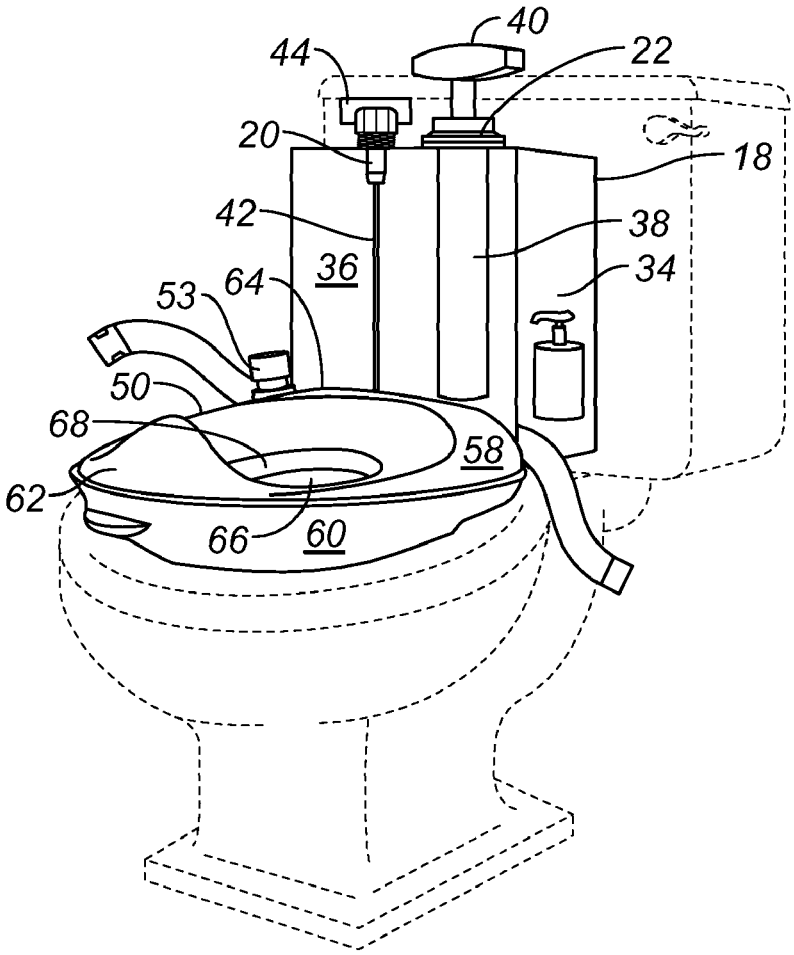
FIG. 8 is a perspective view of the tank assembly and seat assembly of FIG. 2 in use with a standard toilet bowl (in phantom).

In an alternative embodiment as illustrated in FIG. 8, the user can place the joined tank assembly 12 and seat assembly 14, defining the sanitizer device of the present invention as a separate add-on device, onto a seat of a standard toilet bowl instead of placing it onto the stand 16. In particular, seat 50 would rest of the seat of the standard toilet bowl and the back surface 30 of tank 18 would be supported by the front of the tank of the standard toilet bowl. In this embodiment, the user would not have to use the waste container 54 as the liquid drain off would drain directly through the center hole 66 into the basin of the standard toilet bowl. In addition, it should be readily apparent that the sanitizer device is easily portable since it can be packed into a relatively small area of space and then transported to any other desired location.

It is anticipated that the major components in the tank assembly, seat assembly and stand may each be manufactured by injection molding from a high-impact polypropylene or similar durable plastic material.

It should be appreciated by those skilled in the art that the components of the portable baby sanitizer with air pump in the present invention may be made of different sizes and dimensions which can be scaled up so as to accommodate an adult.

From the foregoing detailed description, it can thus be seen that the present invention provides a portable baby sanitizer with air pump device which allows a user to activate a pressurizable chamber, that will dispense a multiplicity of liquid streams onto, and in order to cleanse, a baby's bottom. The sanitizer device includes the pressurizable chamber which has an air pump and an air release valve. The chamber is in direct fluid flow communication with a seat. The seat contains a liquid holding reservoir which dispenses a liquid spray, when the air release valve is engaged, through a plurality of discharge holes that are disposed along the inner rim of the seat. The sanitizer device can be used in conjunction with an independently transportable stand or in conjunction with a standard toilet.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. A portable sanitizer device which allows a user to cleanse and treat a baby's bottom from diaper rash, comprising:

a tank being formed of a top surface, a bottom surface, a front surface, a back surface, a left side surface and a right side surface all interconnected together so as to define a chamber therein;

an air pump being connected to said top surface of said tank;

an air release assembly being disposed within said tank, said air release assembly including a shaft, a cap and a valve plunger;

said shaft having a first end and a second end, said cap being connected to said first end of said shaft of said air release assembly, and said valve plunger being connected to said second end of said shaft of said air release assembly;

said cap being further connectable to said top surface of said tank;

a seat having a top portion, a bottom portion, a front end, a back end, a reservoir disposed therein, and a center hole, said center hole having an inner rim;

said inner rim having a plurality of discharge holes disposed thereon, said discharge holes being in fluid flow communication with said reservoir;

said top portion of said seat having a fill hole disposed thereon;

said bottom surface of said tank having a socket, in fluid flow connection with said reservoir, disposed thereon, said socket being adaptable to receive said valve plunger in order to create an air-tight seal within said chamber; and said bottom surface of said tank being connected to said top portion of said seat such that pressurized air in said tank can be applied to a fluid in said reservoir in order to force said fluid through said discharge means.

2. A portable sanitizer device as claimed in claim 1, wherein said portable sanitizer device is adaptable for use with an independently transportable stand.

3. A portable sanitizer device as claimed in claim 1, further including first and second rail tracks being mounted onto said bottom portion of said seat, said first and second rail tracks being capable of receiving a waste container.

4. A portable sanitizer device as claimed in claim 1, further including restraining means being connected to said tank for safely securing a baby to said device.

5. A portable sanitizer device as claimed in claim 1, further including a soap dispenser being attachable to said tank.

6. A portable sanitizer device as claimed in claim 1, wherein said air pump is a manually operated hand pump.

7. A portable sanitizer device as claimed in claim 1, wherein said plurality of discharge holes includes a first set of three discharge holes and a second set of three discharge holes, said first set being oppositely and symmetrically disposed, across said center hole, to said second set.

8. A portable sanitizer device as claimed in claim 1, wherein said portable sanitizer device is adaptable for use with a standard toilet.

9. A portable sanitizer device, comprising:

a tank;

pump means being connectable to said tank for compressing air in said tank;

air release means being disposed on said tank for releasing pressure and for creating an air-tight seal within said tank;

a seat having a top portion, a bottom portion, a front end, a back end, a reservoir disposed therein, and a center hole, said center hole having an inner rim;

discharge means disposed on said inner rim for spraying liquid, said discharge means being in fluid flow communication with said reservoir; and said tank being connected to said top portion of said seat such that pressurized air in said tank can be applied to a fluid in said reservoir in order to force said fluid through said discharge means.

10. A portable sanitizer device as claimed in claim 9, wherein said portable sanitizer device is adaptable for use with a standard toilet.

11. A portable sanitizer device as claimed in claim 9, wherein said air pump is a manually operated hand pump.

12. A portable sanitizer device as claimed in claim 9, further including restraining means being connected to said tank for safely securing a baby to said device.

13. A portable sanitizer device as claimed in claim 9, further including a soap dispenser being attachable to said tank.

14. A portable sanitizer device as claimed in claim 9, wherein said discharge means for spraying liquid is comprised of a plurality of discharge holes.

15. A portable sanitizer device as claimed in claim 14, wherein said plurality of discharge holes includes a first set of discharge holes and a second set of discharge holes, said first set being oppositely and symmetrically disposed, across said center hole, to said second set.

16. A portable sanitizer device, comprising:

a tank;

pump means being connectable to said tank for compressing air in said tank;

air release means being disposed on said tank for releasing pressure and for creating an air-tight seal within said tank;

a seat having a top portion, a bottom portion, a front end, a back end, a reservoir disposed therein, and a center hole, said center hole having an inner rim;

discharge means disposed on said inner rim for spraying liquid, said discharge means being in fluid flow communication with said reservoir; and said tank being connected to said top portion of said seat such that pressurized air in said tank can be applied to a fluid in said reservoir in order to force said fluid through said discharge means; and support means for raising said tank and said seat from off the ground, said bottom portion of said seat being in direct contact with said support means.

17. A portable sanitizer device as claimed in claim 16, wherein said support means is a stand.

18. A portable sanitizer device as claimed in claim 16, further including first and second rail tracks being mounted onto said bottom portion of said seat, said first and second rail tracks being capable of receiving a waste container.

19. A portable sanitizer device as claimed in claim 16, wherein said discharge means for spraying liquid is comprised of a plurality of discharge holes.

20. A portable sanitizer device as claimed in claim 19, wherein said plurality of discharge holes includes a first set of discharge holes and a second set of discharge holes, said first set being oppositely and symmetrically disposed, across said center hole, to said second set.

* * * * *